US006485673B1

(12) United States Patent
Horbach

(10) Patent No.: US 6,485,673 B1
(45) Date of Patent: Nov. 26, 2002

(54) POURING DEVICE FOR METALLURGIC VESSELS AND A METHOD FOR CONTROLLING THE QUANTITY OF DISCHARGE

(75) Inventor: Ulrich Horbach, Neuss (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/631,861

(22) Filed: Aug. 3, 2000

Related U.S. Application Data

(63) Continuation of application No. PCT/DE98/02931, filed on Sep. 25, 1998.

(30) Foreign Application Priority Data

Nov. 17, 1997 (DE) ..... 197 53 026

(51) Int. Cl.[7] ..... B22D 41/08

(52) U.S. Cl. ..... 266/45; 266/236; 222/590; 222/600

(58) Field of Search ..... 222/590, 591, 222/597, 600; 266/45, 236

(56) References Cited

U.S. PATENT DOCUMENTS 3,990,614 A * 11/1976 Matsuo et al. ..... 222/600
4,077,457 A * 3/1978 Hashio et al. ..... 222/600

FOREIGN PATENT DOCUMENTS

JP 405318062 A * 12/1993 ..... 222/600

* cited by examiner

*Primary Examiner*—Scott Kastler
(74) *Attorney, Agent, or Firm*—Cohen, Pontani, Lieberman & Pavane

(57) ABSTRACT

A pouring device for metallurgic vessels, particularly for steel melts, with slide plates which can be adjusted and slid out again one behind the other in a row under a vessel opening and into which filters can be inserted, and with an immersion pipe projecting into a mold. The slide plates have a filter part which is provided with openings arranged in the casting direction and at least one solid web plate part actuators are provided by which the slide plates can be displaced in the conveying direction (x-direction) and, in addition, in the same plane, but vertical to the conveying direction (i.e., in the y-direction).

7 Claims, 1 Drawing Sheet

POURING DEVICE FOR METALLURGIC VESSELS AND A METHOD FOR CONTROLLING THE QUANTITY OF DISCHARGE

PRIORITY CLAIM

This is a continuation of application No. PCT/DE98/02931, filed on Sep. 25, 1998. Priority is claimed on that application: Germany, Application No.: 197 53 026.5, Filed: Nov. 17, 1997.

BACKGROUND OF THE INVENTION

1. Field of the Invention

The invention is directed to a pouring device for metallurgic vessels, particularly for steel melts, with slide plates which can be adjusted and slid out again one behind the other in a row under a vessel opening and into which filters can be inserted. The invention further relates an immersion pipe projecting into a mold, and to a method for controlling the outflow quantity.

2. Discussion of the Prior Art

A ceramic filter which can be installed in refractory wearable parts through which a melt flows is known from German reference DE 40 12 093 for refining metallurgic melts, in particular steel melts. In one constructional form, slide plates which carry out a plurality of different functions are constructed as a through-slide closure; individual plates which are adjustable and can be slid out again are arranged on rails one behind the other in a row under a vessel opening.

The discharge closure known from this reference is supposed to make it possible to exchange clogged filters quickly and with reliable operation during the casting operation.

It is disadvantageous in this arrangement that the filter is gradually clogged during the casting operation and the resistance in the pour-out opening continuously increases. The gradual clogging causes a rise in the pressure loss exerted by the filter. This rise must be compensated by the opening of an additional control armature which is in a partly closed position when the filter is completely clear. Regulation of the casting surface level must also take place via this device.

Further, the gradual clogging of the filter causes an increase in the filtering effect, so that when the filter is completely clear the degree of purity of the melt is relatively poor, but is relatively good when the filter is almost stopped up. It is accordingly impossible for the degree of purity of the melt to be maintained constant over a long casting period.

The filter can only be exchanged as a complete structural component part. Exchanging the filter element entails interrupting the supply of melt to the mold. Depending on the duration of this interruption, the casting speed must be appreciably reduced in order to continue the casting operation. Strong turbulence is brought about in the mold when pouring is initiated again, which results in a clear drop in quality of the strand in question.

SUMMARY OF THE INVENTION

The object aimed at by the invention is to provide a pouring device for metallurgic vessels in which the molten metal flowing out is filtered in a constant manner accompanied by uniform flow conditions in the immersion pipe.

According to the invention, the immersion casting pipe is closed by a slide plate which has a filter part that is displaceable transverse to the pour-out direction in a manner which can be predetermined and that maintains a constant open through cross section in the immersion casting pipe. For this purpose, the quantity of melt flowing down through the immersion casting pipe is detected and serves at the same time as a measure for the clogging of the filter openings, and the slide plates are displaced in a suitable manner.

Slide plates which have a filter part having openings arranged in the casting direction and which have at least one solid web plate part are used for this purpose. Further, actuators are provided by which the slide plates can be displaced in the conveying direction (x-direction) and, in addition, in the same plane, but perpendicular thereto (i.e., in the y-direction). These actuators communicate, via regulating devices, with measuring elements by which the flow through the immersion casting pipe can be detected.

The clear cross section can be increased or reduced, as desired, during the casting operation by means of the individual parts of the slide plates, the filter part and the solid web part.

The diameter of the openings provided in the filter part is d=0.2 to 1 mm. In an advantageous construction, the openings are slit-shaped with a length-to-width ratio of l/b=5/1 to 8/1.

The device according to the invention enables a constant operating run over optionally long time periods because the filter segments can be exchanged without affecting the operating run.

An additional control armature is not required because the regulating of the casting level in the mold is performed by the filter itself. The possibility of displacing in the x-direction and y-direction is made use of for this purpose, or the filter bores which have already been clogged are used as a closed regulating plate.

Due to the fact that the melt flows out of the filter part of the slide plate uniformly, favorable flow conditions result in the flow channel located below the latter as well as in the mold, which has a positive influence on the steel quality.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWING

FIG. 1 shows a distributor 11, not shown in more detail, which has a distributor discharge block 12 with a casting channel 13.

Figure 1:
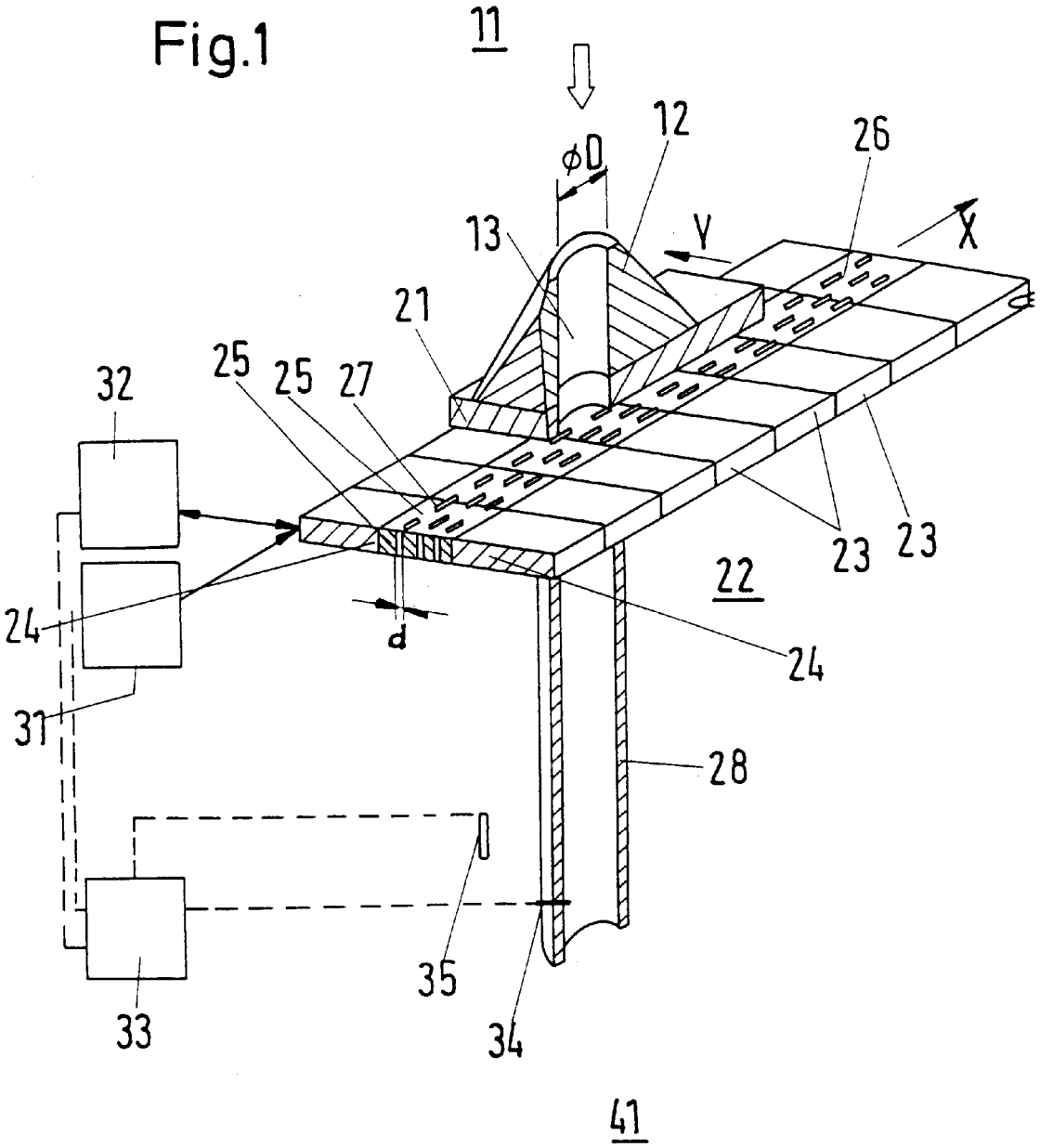
FIG. 1 schematically illustrates the inventive device.

The distributor discharge block 11 is connected with an upper guide plate 21 and a lower guide plate 22 which is not shown in the FIGURE.

Slide plates 23 can be pushed through between the upper guide plate 21 and the lower guide plate 22.

In the present view, the individual slide plates 23 have two solid web plate parts 24 which are arranged on both sides of a filter part 25. Openings 27 are provided in the filter part 25; these openings 27 are still completely open in the left-hand portion of the FIGURE and are at least partly clogged in the right-hand portion of the FIGURE as filter part 26.

The slide plates 23 are operatively connected with actuators 31 so as to work in the conveying direction (x-direction)

and with actuators 32 so as to work transverse to the conveying direction (i.e., in the y-direction). The accuators 31, 32 communicate with a regulating device 33 which is connected with measuring elements 34 for detecting through-flow quantity and with measuring elements 35 for measuring the level.

The distributor discharge block 12 has a casting channel 13 which continues below the slide plates 23 as an immersion casting pipe 28 projecting into a mold 41, not shown in more detail.

As was indicated, the slide plates 23 can be displaced by the two actuators 31, 32. At the start of a casting process, a partial area of the filter part 26 and a partial area of the solid web plate part 24 can be located under the casting pipe, for example. As the filter part gradually becomes clogged in the course of pouring, the actuator 32 is actuated. This actuator 32 then displaces the slide plates 23 in the y-direction in such a way that more filter surface is cleared, i.e., the partial area of the solid web plate part 24 under the casting pipe is reduced. When the entire filter is clogged, the slide plates are displaced by the actuators in the x-direction and y-direction until the starting state described above is restored or another desired position has been adjusted. As can be seen, a complete closing of the outlet opening of the casting pipe is, of course, also possible in this way.

The invention is not limited by the embodiments described above which are presented as examples only but can be modified in various ways within the scope of protection defined by the appended patent claims.

What is claimed is:

1. A pouring device for a metallurgic vessel, comprising: slide plates which can be adjusted and slid out again one behind the other in a row under a vessel opening; an immersion pipe beneath the slide plates, the slide plates having a filter part which is provided with openings arranged in a casting direction and at least one solid web plate part; first actuator means for displacing the slide plates in a conveying direction (x-direction); second actuator means for displacing the slide plates perpendicular to the conveying direction (y-direction) and in a common plane; measuring means for detecting flow through the immersion casting pipe; and a regulating device that places the actuating means and the measuring means in operative communication.

2. A pouring device according to claim 1, wherein the measuring means includes measuring elements which indicate a melt level in a mold downstream of the immersion casting pipe.

3. A pouring device according to claim 1, wherein the filter part and the solid web plate part each have a surface area wherein a relation of the surface area of the filter part to the surface area of the solid web plate part is F/P=0.3 to 0.7.

4. A pouring device according to claim 3, wherein the filter part has openings with a diameter (d) of d=0.2 to 1.0 mm.

5. A pouring device according to claim 3 wherein the openings are slit-shaped with a length-to-width-ratio of 1/b=5/1 to 8/1.

6. A method for controlling the discharge quantity of a melt which flows out of a metallurgic vessel via an immersion pipe which can be closed off by slide plates, comprising the steps of:

guiding the melt flowing through the immersion casting pipe through a filter;

simultaneously detecting the quantity of melt flowing through the immersion casting pipe; and adjusting a clear cross section of the filter by displacing the slide plates in a conveying direction (x-direction) and in a direction perpendicular thereto (y-direction) so that the quantity of melt flowing through remains constant.

7. A method according to claim 6, wherein the filter is a part of a slide plate which likewise has solid web plate parts, and displacement in the conveying direction (x-direction) not having carried out until a full width of the filter part of the slide plate perpendicular to the conveying direction has been utilized.

* * * * *